United States Patent [19]

Roccaforte

[11] 4,279,376

[45] Jul. 21, 1981

[54] CARTON WITH UNOBTRUSIVE HANGING PANEL

[75] Inventor: Harry I. Roccaforte, Western Springs, Ill.

[73] Assignee: Champion International Corporation, Stamford, Conn.

[21] Appl. No.: 137,451

[22] Filed: Apr. 4, 1980

[51] Int. Cl.[3] ..... B65D 5/18

[52] U.S. Cl. ..... 229/38; 229/17 B; 229/33; 206/45.14; 206/806

[58] Field of Search ..... 229/33, 36, 38, 17 B; 206/806, 45.14

[56] References Cited

U.S. PATENT DOCUMENTS

| | | | |
|---|---|---|---|
| 1,223,013 | 4/1917 | Wilson | 229/38 |
| 1,956,642 | 5/1934 | Einson | 229/17 B X |
| 3,003,620 | 10/1961 | Srofe | 206/45.14 |
| 3,625,411 | 12/1971 | Cote | 229/37 R |
| 3,814,303 | 6/1974 | Smith | 229/38 |
| 3,826,420 | 7/1974 | Bamburg et al. | 229/33 |
| 3,946,936 | 3/1976 | Brown | 229/38 |
| 3,985,232 | 10/1976 | Johnson | 229/38 |
| 4,146,128 | 3/1979 | Hogg et al. | 206/806 |

*Primary Examiner*—Davis T. Moorhead
*Attorney, Agent, or Firm*—Evelyn M. Sommer

[57] ABSTRACT

A carton, erected from a one-piece paperboard blank, includes an unobtrusive hanging panel strengthened by a reinforcing panel, the hanging panel initially being attached to the bottom of a carton by side flaps. In order to hang the carton the hanging panel is swung away from the carton by breaking score lines. After the carton has been opened the hanging panel may be used as a recloseable tuck.

6 Claims, 2 Drawing Figures

CARTON WITH UNOBTRUSIVE HANGING PANEL

BACKGROUND OF THE INVENTION

The present invention relates to a carton construction and to a paperboard blank from which the carton is constructed. More particularly, the present invention relates to a carton having a hanging panel from which the carton may be hung.

Small paperboard cartons are widely employed to package and dispense such products as cotton swabs, nails and sundries. However, there may be certain disadvantages because of the limited ways they can be displayed. Generally, two possibilities for displaying small cartons exist. If the carton is constructed with a hanging panel, it may be hung on some sort of hanging device, such as a protruding rod or wire, but its display on a shelf may give an unattractive or disorderly appearance due to its protruding hanging panel. The other possibility which exists is the construction of a carton without a hanging panel which may be displayed lying flat or in an upright position on a shelf.

Generally, cartons presently used having hanging panels usually contain an extensive back panel which protrudes beyond the carton body and which are used only to hang the carton.

SUMMARY AND OBJECTIVES OF THE INVENTION

Exhibited in the present invention is an unobtrusive hanging panel which may be formed as part of any of several types of cartons. This hanging panel may be positioned flat against a bottom panel, without protruding beyond the carton body, and the carton thus stored on a shelf in a stacked manner. On the other hand, if the retail proprietor desires to hang the carton on a hanging device, such as a rod, for display purposes, the hanging panel can be lifted from the bottom panel by breaking at corner perforations. Once the carton is opened, the hanging panel may then be used as a recloseable tuck.

It is an objective of the present invention to provide a carton with an unobtrusive hanging panel which can either remain attached by side flaps to the bottom panel or may be lifted so the carton can be hung on a hanging device such as a metal rod.

It is a further objective of the present invention to provide such a carton in which the unobtrusive hanging panel may be utilized as a recloseable tuck.

It is a further objective of the present invention to provide a one-piece paperboard blank from which such a carton may be constructed, thereby permitting the carton to be manufactured in a relatively economical manner and using conventional machinery.

BRIEF DESCRIPTION OF THE DRAWINGS

Further objectives and advantages of the invention will become apparent from a reading of the following detailed description taken in conjunction with the drawings, in which.

DETAILED DESCRIPTION OF THE INVENTION

Figure 1:
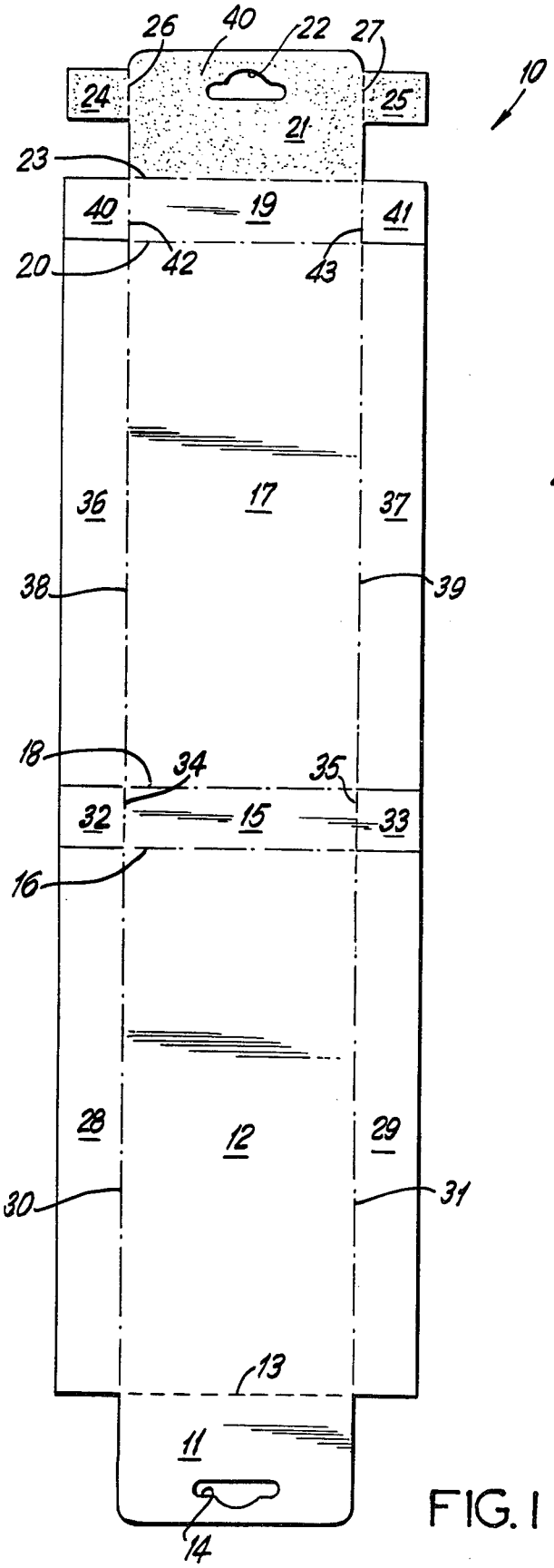
FIG. 1 is a top plan view of a blank adapted to be erected into the carton as shown in FIG. 2.

FIG. 1 depicts a top plan view of a carton blank which, when erected, forms a carton having an unobtrusive hanging panel. The carton blank 10 includes a reinforcement panel 11 which is attached to a rectangular bottom panel 12 by a back fold and breakable score line 13. The reinforcement panel has a hole 14 therethrough. A first rectangular side panel 15 is connected by fold line 16 to the bottom panel 12. A rectangular top panel 17, identical to bottom panel 12 in size and shape, is connected to the first side panel 15 by a fold line 18.

A rectangular second side panel 19, identical in size and shape to the first panel 15, is connected to the top panel 17 by a fold line 20. A hanging panel 21, having a hole 22 therethrough by which the carton may be hung, is connected to the second side panel 19 by a line 23. Preferably the paperboard materials within the holes 14–22 are left in place so that they may be removed by the retailer who may display the carton.

A pair of side flaps 24 and 25 are connected at opposite sides of the hanging panel 21 by breakable fold and score lines 26 and 27, respectively.

The bottom panel 12 and the top panel 17 each have a pair of opposite side flaps 28,29 and 36,37 respectively connected to them by fold lines 30,31 and 38,39, respectively. Also, the first side panel 15 and the second side panel 19 have their respective opposite pairs of side flaps 32,33 and 40,41 connected to them by fold lines 34,35 and 42,43, respectively.

A single line of adhesive 40, shown by speckled dots, applied across the side flaps 24,25 and hanging panel 21, is used to adhere the hanging panel 21 to the reinforcement panel 11 and to adhere the side flaps 24,25 to the respective inside side flaps 28,29.

Upon erection of the carton, the reinforcement panel 11 is folded completely backwards from the position shown in FIG. 1 and is aligned and adhered to the hanging panel 21 with the respective holes 14,22 aligned. FIG. 1 shows the side of the carton which becomes the inside (interior) of the carton. It is the top sides, as shown in FIG. 1, of the reinforcement panel 14 and the hanging panel 21 which are adhered together. The hanging panel 21 is positioned on the outside, and flat against, the bottom panel 12. The side flaps 24,25 are then adhered to the outside (the side not shown in FIG. 1) of the flaps 28,29, respectively. This retains the reinforcement panel 11 and its attached hanging panel 21. The side flaps 36,37 are the outside flaps. The erected carton is filled, closed, glued and shipped. It will pack, and may be displayed on a shelf, as a conventional three-dimensional rectangular carton.

To hang the carton, the retailer or user would lift the hanging panel 21, breaking the score lines 26,27.

Figure 2:
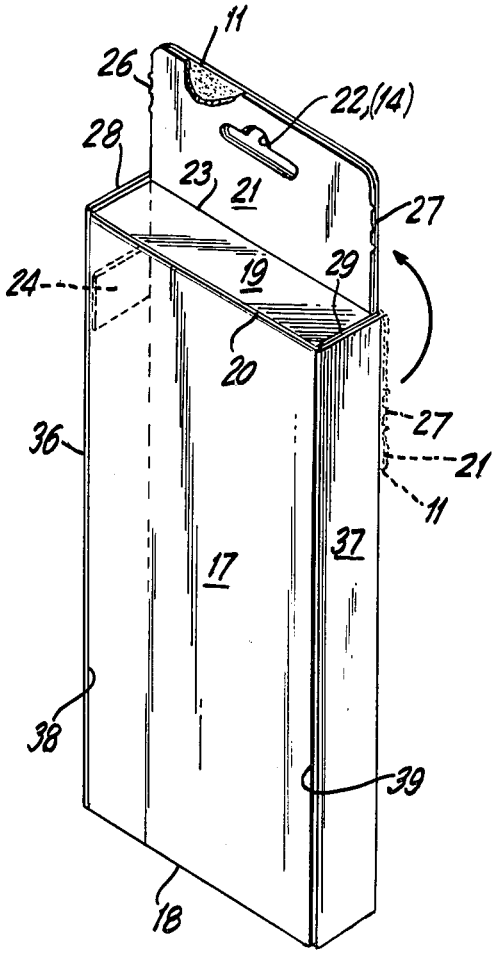
FIG. 2 is a perspective view of an assembled carton which embodies the present invention.

The hanging panel 21, reinforced by its adhered reinforcement panel 11, will be positioned in the plane of the bottom panel 12, as shown in FIG. 2. The holes 14,22 may be used to hang the carton on a wire or other support.

In use, the customer breaks the perforated line 13 to open the package. The package may subsequently be closed, by the customer, by inserting the adhered hanging panel 21—reinforcement panel 11, along with the side flaps 40,41 into the opening at the end opposite panel 15.

What is claimed is:

1. A one-piece paperboard carton blank from which may be erected a carton having an unobtrusive integral panel to hang the carton, the said blank comprising, in sequence arranged along a common axis;

a reinforcement panel having a hole therethrough, a rectangular bottom panel connected by a back fold and score line to said reinforcement panel, a rectangular first side panel connected by a fold line to said bottom panel, a rectangular top panel connected by a fold line to said rectangular first side panel, a rectangular second side panel connected by a fold line to the top panel;

a hanging panel connected to said second side panel by a fold line, said hanging panel having a hole therethrough to align with the hole in the reinforcement panel and by which the carton may be hung;

and, in addition and not on said axis, opposite pairs of side flaps connected by fold lines to at least two of said panels;

and a pair of side flaps connected at opposite sides of said hanging panel by breakable score lines.

2. A carton blank as in claim 1 wherein a pair of opposed side flaps is connected to each of said top, bottom and side panels by fold lines.

3. A carton blank as in claim 1 and further including an adhesive applied on one side of said hanging panel and on the same side of said pair of side flaps.

4. An erected carton erected from a one-piece paperboard blank and having an unobtrusive integral panel from which the carton may be hung, the said carton comprising:

a reinforcement panel having a hole therethrough, a rectangular bottom panel connected by a back fold and breakable score line to said reinforcement panel, a rectangular first side panel connected by a fold line to said bottom panel, a rectangular top panel connected by a fold line to said rectangular first side panel, a rectangular second side panel connected by a fold line to the top panel, opposite pairs of panel side flaps connected by fold lines to at least two of said panels to close the carton; and a hanging panel positioned parallel with said bottom panel and connected to said second side panel by a fold line and adhered to said reinforcing panel, said hanging panel having a hole therethrough aligned with the hole in the reinforcing panel by which the carton may be hung, and a pair of side flaps adhered to panel side flaps and connected at opposite sides to said hanging panel by breakable score lines;

whereby said hanging panel may be broken away from its side flaps and its hole used to hang the carton.

5. A carton as in claim 3 wherein a pair of opposed side flaps is connected by fold lines to each of said top, bottom and side panels to thereby close the carton.

6. A carton as in claim 3 wherein said carton may be opened by breaking the breakable score line of said reinforcement panel and the reinforcement panel and its connected hanging panel may subsequently be used to close the carton.

* * * * *